US011767963B2

(12) United States Patent
Li

(10) Patent No.: US 11,767,963 B2
(45) Date of Patent: Sep. 26, 2023

(54) APPARATUS AND METHODS FOR VEHICLE LAMP VENTILATION AND TEMPERATURE CONTROL

(71) Applicant: Xin Dong, Smithville, TX (US)

(72) Inventor: Haifeng Li, Yizhou (CN)

(73) Assignee: Xin Dong, Smithville, TX (US)

( * ) Notice: Subject to any disclaimer, the term of this patent is extended or adjusted under 35 U.S.C. 154(b) by 0 days.

(21) Appl. No.: 17/751,899

(22) Filed: May 24, 2022

(65) Prior Publication Data

US 2022/0282848 A1 Sep. 8, 2022

Related U.S. Application Data

(63) Continuation of application No. 16/488,895, filed as application No. PCT/CN2019/098253 on Jul. 30, 2019, now Pat. No. 11,339,945.

(51) Int. Cl.

| | |
|---|---|
| ***F21S 45/33*** | (2018.01) |
| ***F21S 45/43*** | (2018.01) |
| ***F21V 23/06*** | (2006.01) |

(52) U.S. Cl.

CPC ..... *F21S 45/33* (2018.01); *F21S 45/43* (2018.01); *F21V 23/06* (2013.01)

(58) Field of Classification Search

CPC ..... F21S 45/33; F21S 45/43; F21V 23/06
USPC ..... 362/547
See application file for complete search history.

(56) References Cited

U.S. PATENT DOCUMENTS

2005/0276053 A1* 12/2005 Nortrup ..... F21V 29/67 362/234
2007/0127257 A1* 6/2007 Erion ..... F21V 29/677 362/547

* cited by examiner

*Primary Examiner* — Bryon T Gyllstrom
(74) *Attorney, Agent, or Firm* — NZ CARR LAW OFFICE

(57) ABSTRACT

The present disclosure generally relates to apparatus and methods for controlling ventilation and temperature around a light source. A ventilation and temperature control assembly configured to selectively facilitate air circulation in an enclosure around a light source is disclosed. In some embodiments, a temperature sensor may be disposed near the light source. The air circulation may be switched on and off according to temperature measurement of the temperature sensor. In some embodiments, the ventilation and temperature control assembly includes a valve to selectively open and close a flow path in the ventilation and temperature control assembly.

20 Claims, 9 Drawing Sheets

APPARATUS AND METHODS FOR VEHICLE LAMP VENTILATION AND TEMPERATURE CONTROL

FIELD

The present disclosure relates apparatus and methods for controlling operating environment around a light source. More particularly, the present disclosure relates to apparatus and methods for controlling ventilation and temperature around light sources, such as vehicle lamps.

BACKGROUND

Light sources, such as halogen lamps, xenon lamps, light emitting diode (LED) lights, or laser lights, generate heat during operation. When a light source operates in a relatively closed environment, the heat generated by the light source may cause the ambient temperature around the light source to rise up. In some circumstances, such as in a cold climate, the heat generated by the light source raises the ambient temperature, thereby reducing humidity or defrosting ice formed around the light source. In other circumstances, the heat generated by the light source raises the ambient temperature to an undesirable level that affects the normal operation of the light source and its control circuit, ages structural components of the light source, cause condensation inside the housing. Thus, heat generated by a light source may negatively affect the life span and/or effectiveness of the light source.

Therefore, there is a need for apparatus and methods for controlling ventilation and temperature around a light source.

SUMMARY

The present disclosure includes apparatus and methods for controlling ventilation and temperature around a light source.

Some embodiments of the present disclosure provide a ventilation and temperature control assembly for a light source. The ventilation and temperature control assembly includes a ventilation unit and a sensor. The ventilation unit comprises a housing having a first port and a second port, and a ventilation fan disposed in the housing near the first port, wherein the ventilation fan is configured to facilitate an air flow through the housing between the first port and the second port. The sensor is connected to the ventilation unit, wherein the ventilation fan is switched on and off according to measurements of the sensor.

Some embodiments of the present disclosure provide a climate control device for vehicle lamps, comprising a housing, wherein the housing has an inlet port and an outlet port, and a flow path is formed in the housing between the inlet port and the outlet port, a ventilation fan disposed in the flow path and configured to direct fluid flow from the inlet port to the outlet port, and a valve disposed in the flow path, wherein the valve is operable to open and close the flow path.

Some embodiments of the present disclosure provide a method for controlling a light source. The method includes turning on a light source disposed in a light source housing, monitoring temperature in the light source housing, and extracting an air flow from the light source housing using an external ventilation fan when the temperature in the light source housing reaches a pre-set temperature value.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. It is to be noted, however, that the appended drawings illustrate only typical embodiments of this disclosure and are therefore not to be considered limiting of its scope, for the disclosure may admit to other equally effective embodiments.

Figure 1:
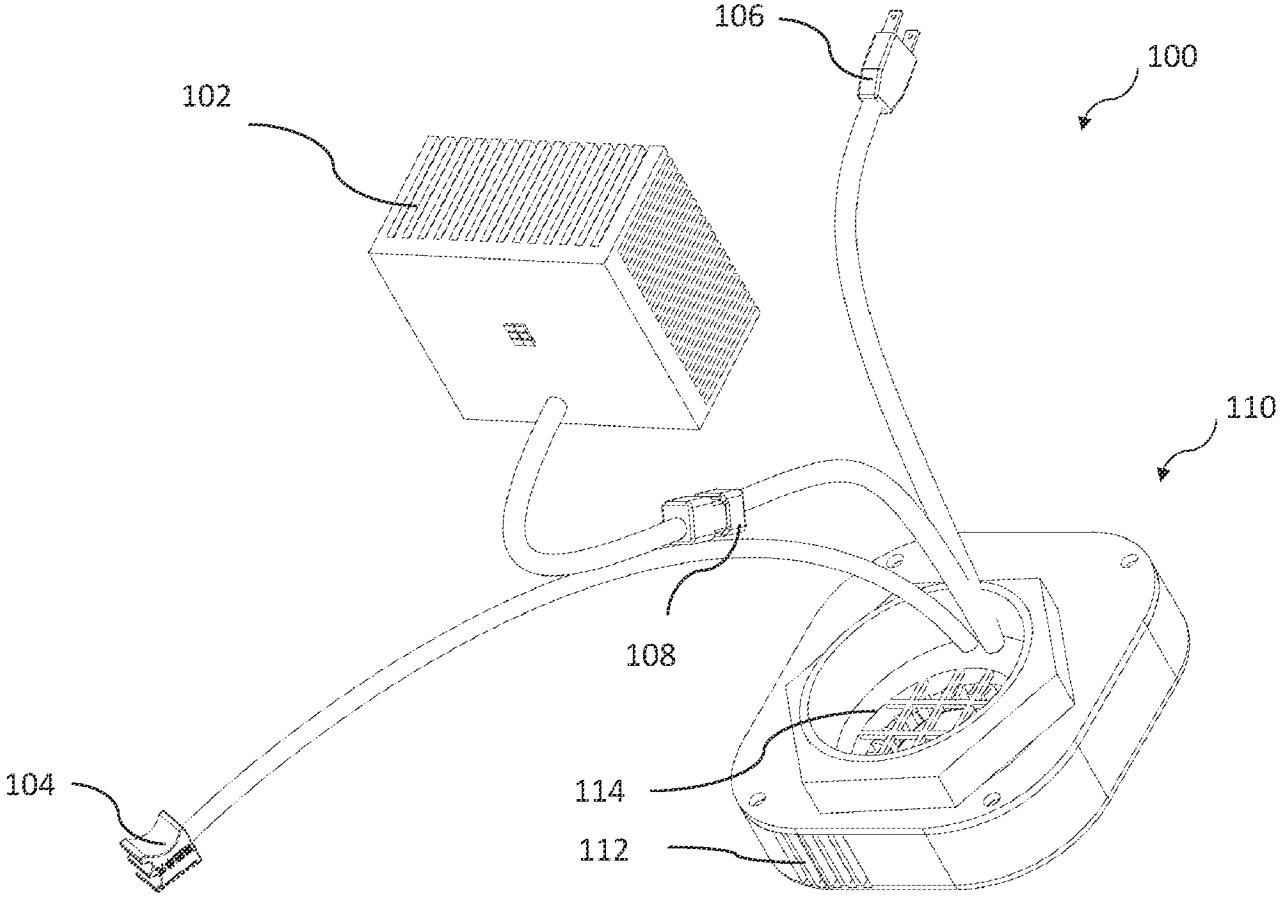
FIG. 1 is a schematic perspective view of a ventilation and temperature control assembly according to embodiments of the president disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present disclosure relate to apparatus and methods for controlling temperature around a light source. In some embodiment, the present disclosure provides a ventilation and temperature control assembly configured to selectively facilitate air circulation in an enclosure around a light source. During operation, the air circulation may be turned off to allow the heat generated by the light source to raise the ambient temperature, or turned on to lower the ambient temperature. The ventilation and temperature control assembly may be disposed through a port of the enclosure. The ventilation and temperature control assembly may include a ventilation fan. In some embodiments, a temperature sensor may be disposed near the light source. The ventilation fan is switched on and off according to temperature measurement of the temperature sensor. In some embodiments, the ventilation and temperature control assembly includes a valve to selectively open and close a flow path in the ventilation and temperature control assembly. In some embodiments, the ventilation and temperature control assembly includes a controller configured to operate the ventilation fan, the temperature sensor, and the valve. In some embodiments, the controller may be formed on a printed circuit board (PCB) and disposed in the flow path of the ventilation and temperature control assembly to be cooled by ventilating air flow. The ventilation and temperature control assembly can be attached to the light source or to an additional opening around the light source housing.

FIG. 1 is a schematic perspective view of a ventilation and temperature control assembly 100 according to embodiments of the president disclosure. The ventilation and temperature control assembly 100 is configured to be installed through a port formed through a light source enclosure to control the ambient temperature around a light source disposed in the light house enclosure. For example, the ventilation and temperature control assembly 100 may be installed through a port formed through a vehicle lamp housing to control the temperature around the vehicle lamp.

The ventilation and temperature control assembly 100 includes a ventilation unit 110 configured to enable air flow. The ventilation unit 110 includes two ports 112, 114. A flow path is defined within the ventilation unit 110 between the two ports 112, 114. The ventilation unit 110 is operable to facilitate an air flow between the ports 112, 114 along the flow path.

When installed, the port 114 connects to a light source enclosure. In some embodiments, the port 112 is an outlet port, the port 114 is an inlet port, and the ventilation unit 110 is configured to draw air flow from the light source enclosure. Alternatively, the port 112 may be an inlet port, the port 114 may be an outlet port, and the ventilation unit 110 may be configured to blow external air into the light source enclosure.

The ventilation and temperature control assembly 100 includes a power adaptor 106 connected to the ventilation unit 110. In some embodiments, the power adaptor 106 is configured to connect to a light source power supply, for example, an onboard power supply for a vehicle lamp in a vehicle.

The ventilation and temperature control assembly 100 includes a light source adaptor 108 configured to connect the ventilation unit 110 to a light source 102. The light source 102 may be any suitable light source, such as a LED light, a halogen lamp, a xenon lamp, a laser light, or the like. In some embodiments, the light source 102 is an independent unit from the ventilation and temperature control assembly 100, for example an existing light source, such as a pre-installed vehicle lamp. In other embodiments, the light source 102 is integrated with the ventilation and temperature control assembly 100. In some embodiments, the ventilation and temperature control assembly 100 may interchangeably with different types of light sources.

In some embodiments, the ventilation and temperature control assembly 100 further includes a sensor 104. The sensor 104 is connected to the ventilation unit 110. In some embodiments, air flow through the ventilation unit 110 is switched on and off according to the measurement of the sensor 104. In some embodiments, the sensor 104 is a temperature sensor, such as a resistive temperature sensor, an electro-mechanical temperature sensor, an electronic sensor, or the like. Alternatively, the sensor 104 may be other types of sensor according to the operation needs. For example, the sensor 104 may be a humidity sensor.

Figure 2:
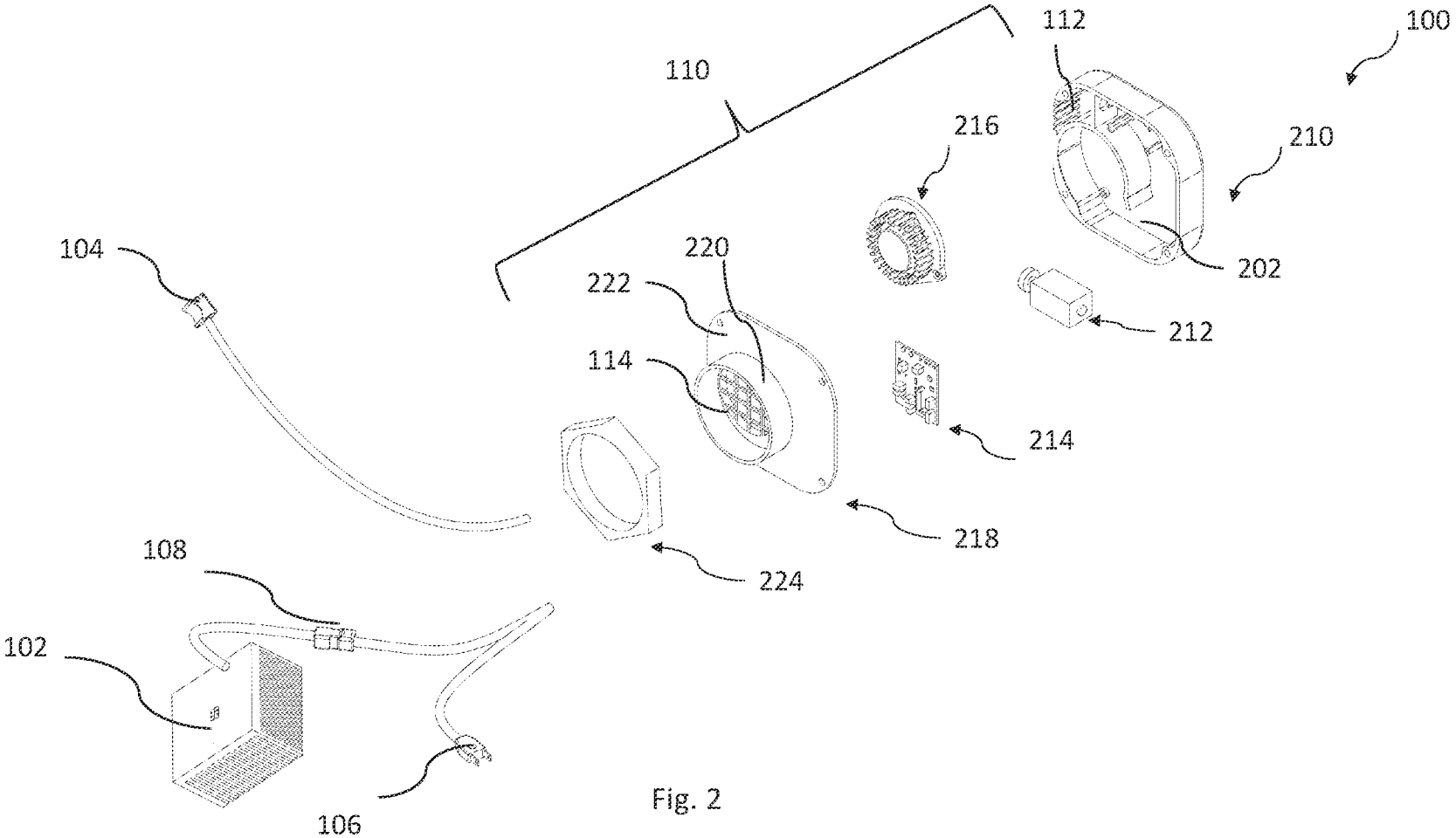
FIG. 2 is an exploded perspective view of the ventilation and temperature control assembly shown in FIG. 1.

FIG. 2 is an exploded perspective view of the ventilation and temperature control assembly 100. FIG. 2 demonstrates one embodiment of the ventilation unit 110. The ventilation unit 110 includes a lower housing 210 and an upper housing 218. When assembled, the lower housing 210 and upper housing 218 are attached to each other and form an enclosure 202 therein. In the embodiment of FIG. 2, the port 114 is formed through the upper housing 218, and the port 112 is formed through the lower housing 210.

The ventilation unit 110 includes a ventilation fan 216 disposed within the enclosure 202 near the port 114. In some embodiments, the ventilation fan 216 is an outer rotor centrifugal fan. Alternatively, the ventilation fan 216 may be any suitable fan for drawing an air flow or for blowing an air flow.

In some embodiments, the ventilation unit 110 includes a valve 212 positioned in the enclosure 202 and configured to open and close a flow path between the port 112 and the port 114. In some embodiments, the valve 212 is an electromagnetic valve. Alternatively, the valve 212 may be any suitable valves or actuator capable of open or close a flow path.

The ventilation and temperature control assembly 100 further includes a controller 214. The controller 214 is connected to the power adaptor 106, the sensor 102, the light source adaptor 108, the ventilation fan 216, and the valve 212. In some embodiments, the controller 214 include a processor, memory, one or more input ports, one or more output ports, and circuitry configured to operate the ventilation fan 216, the valve 212, the sensor 112, and the light source 102 connected to the light source adaptor 108. In some embodiments, the controller 214 includes a computer program operable to communicate with and control the ventilation fan 216, the valve 212, the sensor 112, and the light source 102. The controller 214 may be powered by an external power supply, such as a power supply connected to the power adaptor 106. In some embodiments, the controller 214 is in the form of a PCB. In some embodiments, the controller 214 is positioned in the enclosure 202. Alternatively, the controller 214 may be positioned outside the ventilation unit 110.

In some embodiments, the controller 214 includes a temperature control module, a valve control module, and a light source power module. The temperature control module, the valve control module and the light source power module share the same power supply and communicate with one other through control signals.

The upper housing 218 includes a plate 222 and tubular portion 220 protruding from the plate 222. When assembled, the plate 222 is secured to the lower housing 210 to form the enclosure 202. The port 114 is formed through the plate within an inner volume of the tubular portion 220. In some embodiments, the port 114 may include a plurality of perforations formed through the plate 222. When installed on a light assembly, the tubular portion 220 may be inserted through a port on a housing of the light assembly to enable fluid connection between the light assembly and the enclosure 202 through the port 114.

The temperature assembly 110 further includes a fastener 224 configured to secure to a light assembly, for example, a lamp on a vehicle. The fastener 224 may be any suitable structures capable of securing the ventilation unit 110 to a light assembly, such as a threaded connection, clamps, a clip, nails, pegs, pins, rivets, ties, adhesive connections, or the like.

In some embodiments, the fastener 224 is a nut. In some embodiment, the tubular portion 220 includes an outer threaded section matching the nut. The ventilation unit 110 may be secured to a wall of a light assembly by making a threaded connection between the nut and the tubular portion 220.

Figure 3:
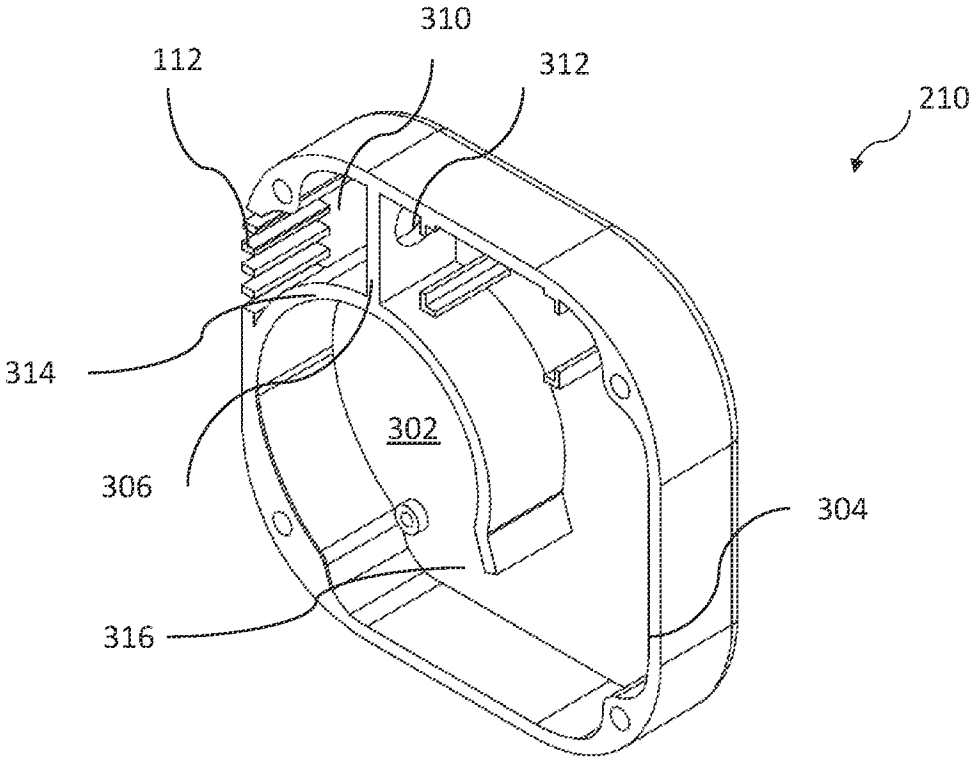
FIG. 3 is a perspective view of a housing of the ventilation and temperature control assembly of FIG. 1.

FIG. 3 is a perspective view of the lower housing 210 of the ventilation and temperature control assembly 100. The lower housing 210 includes a bottom 302 and sidewalls 304. The port 112 is formed through the sidewall 304. Alternatively, the port 112 may formed in other locations, such as through the bottom 302, or through both the sidewall 304 and the bottom 302. In some embodiments, the port 112 may include a plurality of openings, such as a plurality of slits.

In some embodiments, the lower housing 210 includes inner walls 306 and 314. The inner walls 306 and 314 divide the enclosure 202 into an upstream chamber 316 and a downstream chamber 310. When the upper housing 218 is attached to the lower housing 210, the upstream chamber 316 faces the port 114. The downstream chamber 310 faces the port 112. The upstream chamber 316 is connected to the downstream chamber 310 through an inner port 312 formed through the inner wall 306. The inner wall 314 is shaped to facilitate a streamlined fluid flow in the enclosure 202. In some embodiments, the inner wall 314 is in a volute shape.

Figure 4A:
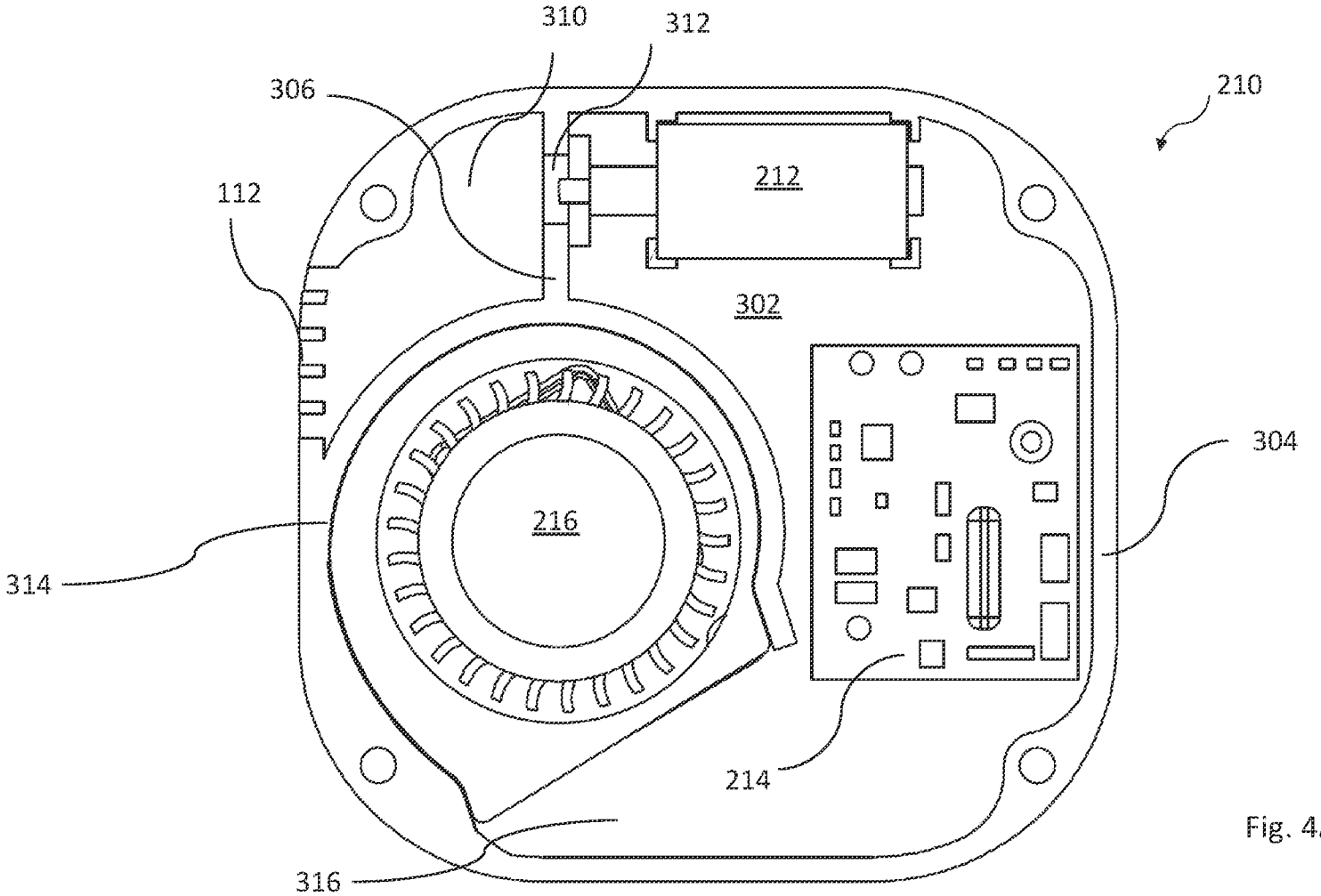
FIG. 4A is a schematic plan view of the ventilation and temperature control assembly of FIG. 1 an internal arrangement.

FIG. 4A is a schematic plan view of the ventilation and temperature control assembly 100 of FIG. 1 showing one embodiment of internal arrangement in the ventilation unit 110. The ventilation fan 216 is disposed in the upstream chamber 316 within a volute shaped space defined by the inner wall 314 so that the ventilation fan 216 directs air flow from the port 114 to the downstream chamber 310.

In some embodiments, the controller 214 is disposed in the upstream chamber 316 within the flow path of the air flow so that the air flow cools the controller 214 during operation.

In some embodiments, the valve 212 is positioned to open and close the inner port 312. The valve 212 is positioned in the upstream chamber 316. When the valve 212 is in the extended position, shown in FIG. 4A, the valve 212 closes the inner port 312 isolating the upstream chamber 316 from environment external to the port 112. When the ventilation fan 216 is not running and there no active air flow from the upstream chamber 316 to the downstream chamber 310, the valve 212 may be set at the extended position to prevent dusts, debris, vapor from entering the ventilation fan 216, the controller 214, the valve 212, and the light source connected to the port 114.

Figure 4B:
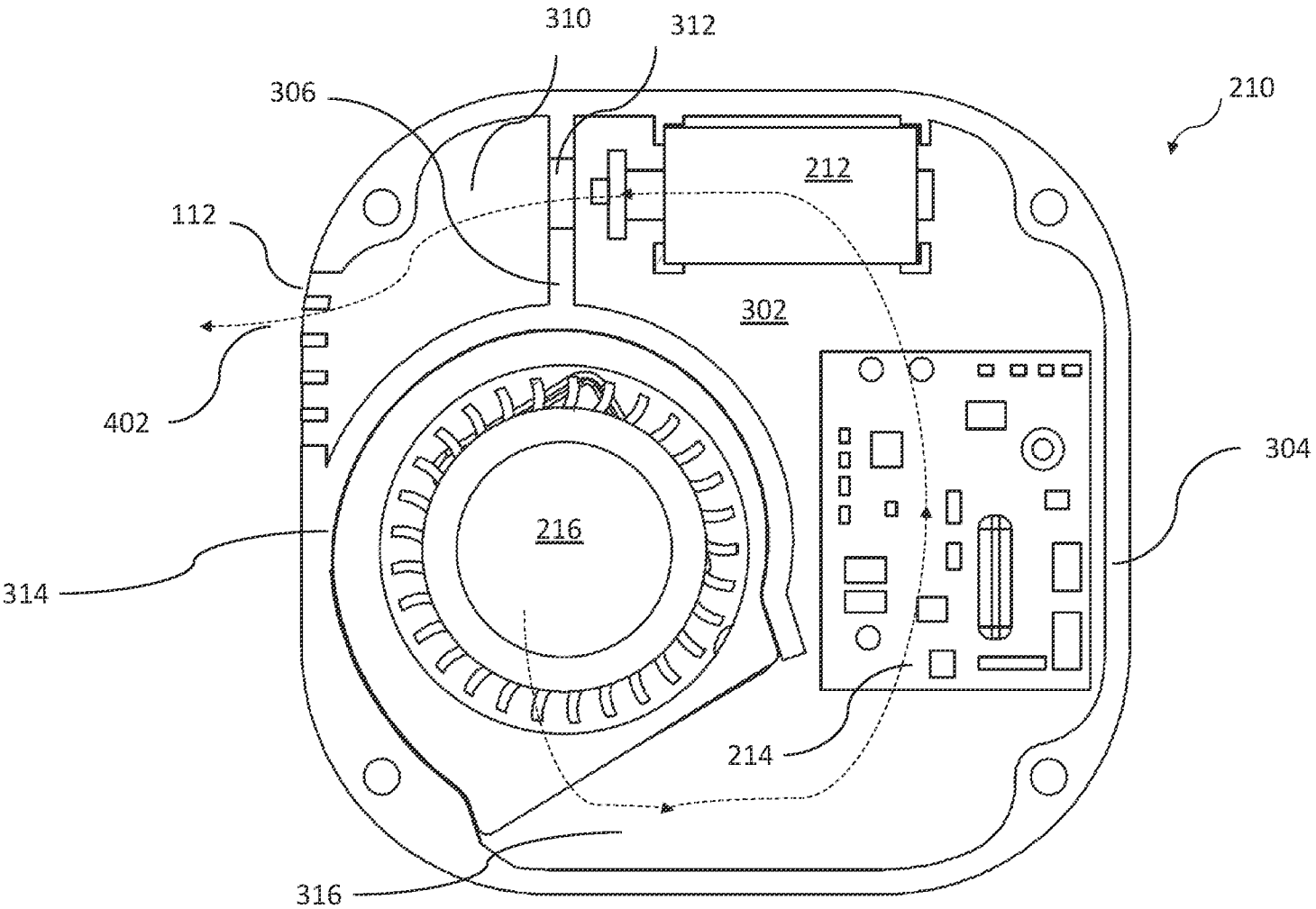
FIG. 4B is the plan view of the ventilation and temperature control assembly of FIG. 1 showing a flow path during operation.

FIG. 4B is the plan view of the ventilation and temperature control assembly 100 showing the valve 212 in a retracted position. When the valve 212 is in the retracted position, the inner port 312 is open allowing a flow path 402 through the enclosure 202 within the ventilation unit 110. During operation, the air flow enters the ventilation unit 110 through the port 114, propelled by the ventilation fan 216 into the upstream chamber 316, flowing by the controller 214, the valve 212, going through the inner port 312 into the downstream chamber 310, and exiting the ventilation unit 110 through the port 112.

In some embodiments, the controller 214 sets the valve 212 in the retracted position to open the inner port 312 prior to running the ventilation fan 216, and sets the valve 212 in the extended position to close the inner port 312 prior to turning off the ventilation fan 216.

Figure 5:
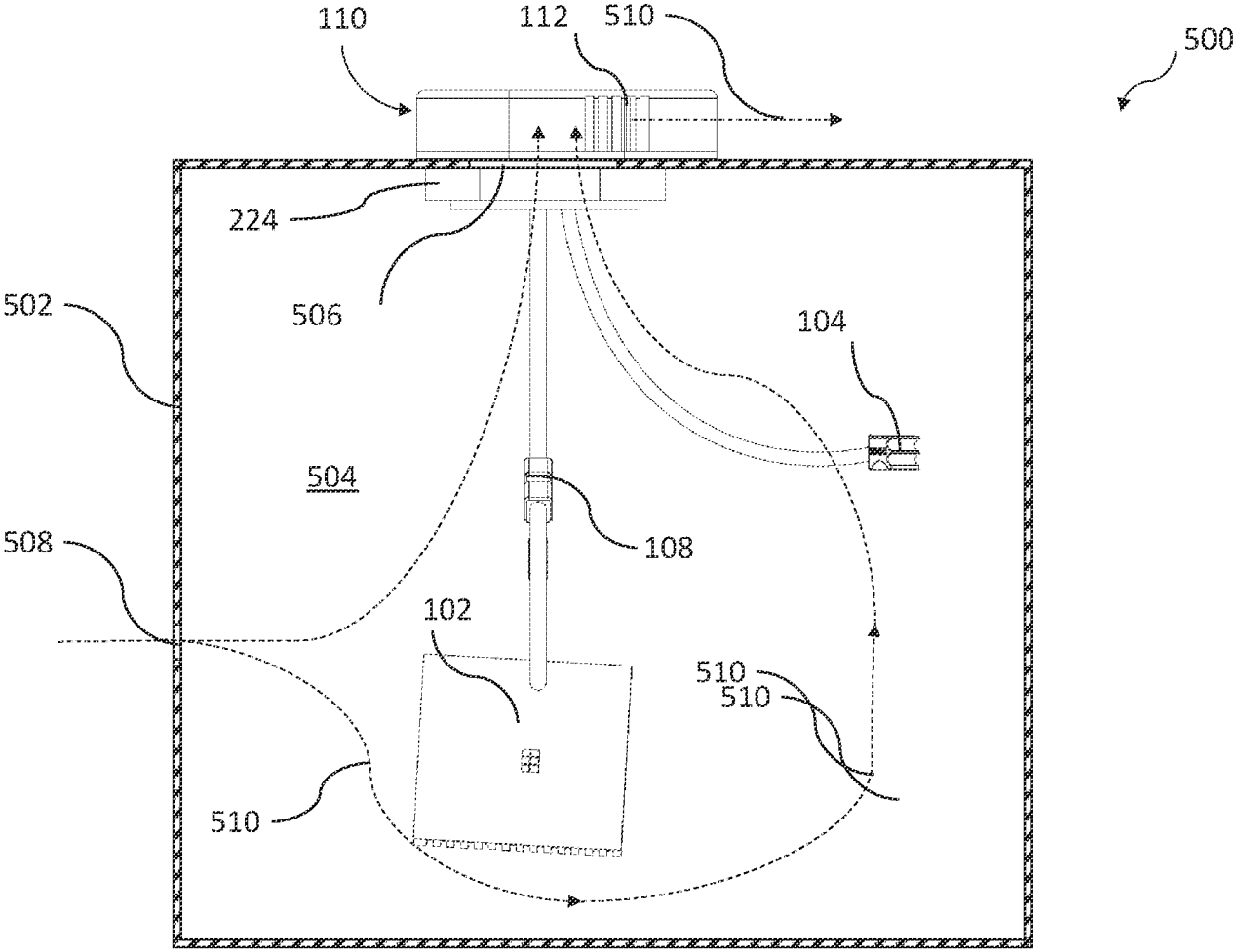
FIG. 5 is a schematic top view of a light source including a ventilation and temperature control assembly according to embodiments of the present disclosure.

FIG. 5 is a schematic top view of a light module 500 including a ventilation and temperature control assembly, such as the ventilation and temperature control assembly 100 according to embodiments of the present disclosure. The light module 500 includes a light housing 502 defining an enclosure 504. The light housing 502 is configured to house a light source, such as the light source 102, therein.

The ventilation and temperature control assembly 100 is mounted on the light housing 502. The ventilation unit 110 is attached to an exterior surface of the light housing 502. The tubular portion 220 of the ventilation unit 110 extends into the enclosure 504 via an opening 506 formed through the light housing 502. In some embodiments, the opening 506 is a pre-existing opening for mounting the light source 102. In other embodiments, the opening 506 is a dedicated port for the ventilation and temperature control assembly 100. The ventilation unit 110 is secured to the light housing 502 by the fastener 224 from inside the light housing 502.

The sensor 104 is disposed inside the enclosure 504 and connected to the ventilation unit 110. In some embodiments, the light source 102 is connected to the ventilation and temperature control assembly 100 through the light source adaptor 108 and the light source 102 is powered by the ventilation and temperature control assembly 100. The ventilation and temperature control assembly 100 is connected to a power source through the power adaptor 106. Alternatively, the light source 102 and the ventilation and temperature control assembly 100 may be powered independently by a power supply.

An air hole 508 is formed through the light housing 502. The air hole 508 is formed to provide venting when air temperature in the enclosure 504 changes and to enable air flow when the ventilation unit 110 in the ventilation and temperature control assembly 100 is operating.

During operation, the ventilation and temperature control assembly 100 monitors the condition, such as temperature or humidity level, in the enclosure 504 using the sensor 104. When the measured temperature reaches a pre-set value, the ventilation fan 216 in the ventilation and temperature control assembly 100 is turned on to draw air from the enclosure 504 through the ventilation unit 110 to the external environment. The air flow generated by the ventilation and temperature control assembly 100 causes a negative air pressure in the enclosure 504. The negative pressure drives outside air into the enclosure 504 through the air hole 508 forming air circulation as shown by flow path 510 in the enclosure 504, thus continuously cooling the light source 102. During cooling, when the measured temperature drops below the pre-set value, the ventilation and temperature control assembly 100 turns off the ventilation fan 216.

Figure 6:
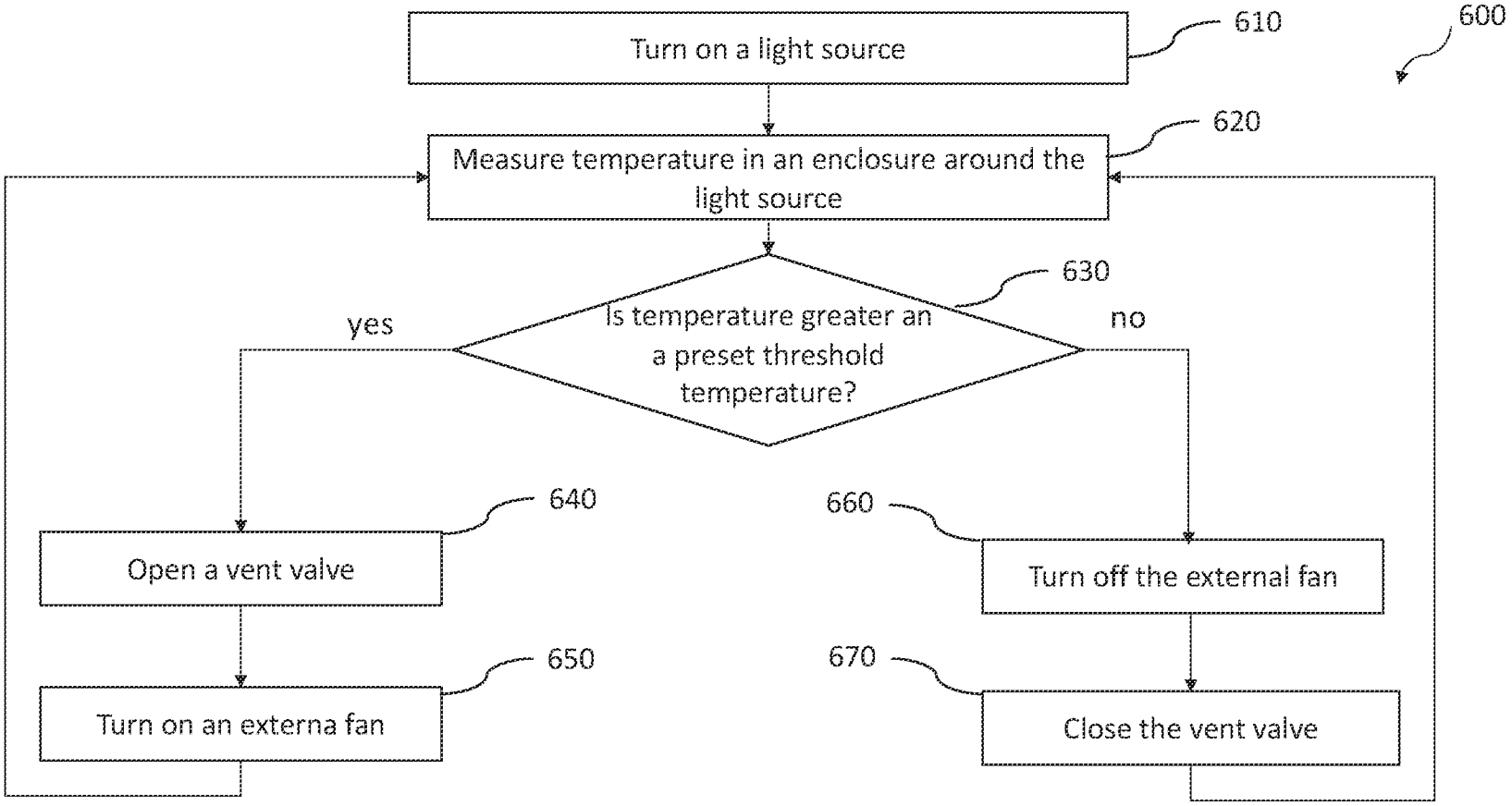
FIG. 6 is a flow chart of a method for controlling light source ambient temperature according to embodiments of the present disclosure.

FIG. 6 is a flow chart of a method 600 for controlling light source ambient conditions according to embodiments of the present disclosure. The method 600 may be used to control temperature any light source operating in an enclosed environment, for example, lights in a vehicle. The method 600 may be used for any light source, such as halogen lamps, xenon lamps, light emitting diode (LED) lights, or laser lights. The method 600 can be performed using the ventilation and temperature control assembly 100 or by the light module 500 according to the present disclosure. In some embodiments, the method 600 may be performed by a program loaded and operated in the controller 214 of the ventilation and temperature control assembly 100.

In operation 610, the light source is turned on. In some embodiments, the light source is turned on by an external power supply, such as a power supply connected to the power adaptor 106 of the ventilation and temperature control assembly 100. In some embodiments, when the light source is a vehicle light, the power supply is an onboard power on the vehicle.

In some embodiments, when the light source is first turned, the light source enclosure remains relatively closed to allow the heat generated by the light source to warm up the ambient environment. As the light source being turned on, temperature around the light source increases thereby vaporizing condensation on the housing or lens of the light and/or defrosting ice formed exterior to the housing or lens.

In operation 620, temperature near the light source is measured and monitored. The temperature may be measured by a sensor disposed near the light source in the enclosure where the light source is positioned. The temperature sensor may be the sensor 104 of the ventilation and temperature control assembly 100.

In operation 630, the measured temperature is compared to a pre-set value. The pre-set value may be determined according to the type of light source to ensure proper operation of the light source. Other conditions, such as the local climate, may also be considered when determine the pre-set value. Operations 640, 650 are performed when the measured temperature is higher than pre-set value. Operations 660, 670 are performed when the measured temperature is lower than the pre-set value. In some embodiments, the pre-set value is in a range between about 30° C. and about 60° C.

In operation 640, a vent valve is opened to allow an outward flow path from the enclosure around the light source. In some embodiments, the vent valve may be the valve 212 in the ventilation and temperature control assembly 100. In some embodiment, operation 640 may be omitted as the ventilation and temperature control assembly includes a permanently open flow path.

In operation 650, an external fan is turned on to draw air flow from the enclosure. In some embodiments, the external fan may be the ventilation fan 216 in the ventilation and temperature control assembly 100. The air flow generated the ventilation and temperature control assembly 100 causes a negative air pressure in the enclosure around the light source. The negative pressure drives outside air into enclosure through air holes formed through the housing around the light source establishing air circulation around the light source, thus continuously cooling the light source.

After operation 650, operation 620 may be performed to continuously monitoring the temperature around the light source.

In operation 660, the external fan is turned off to stop the air circulation around the light source. In operation 670, the vent valve is closed to prevent any dusts, debris, moisture from entering the enclosure around the light source. After operation 670, operation 620 may be performed to continuously monitoring the temperature around the light source.

Figure 7B:
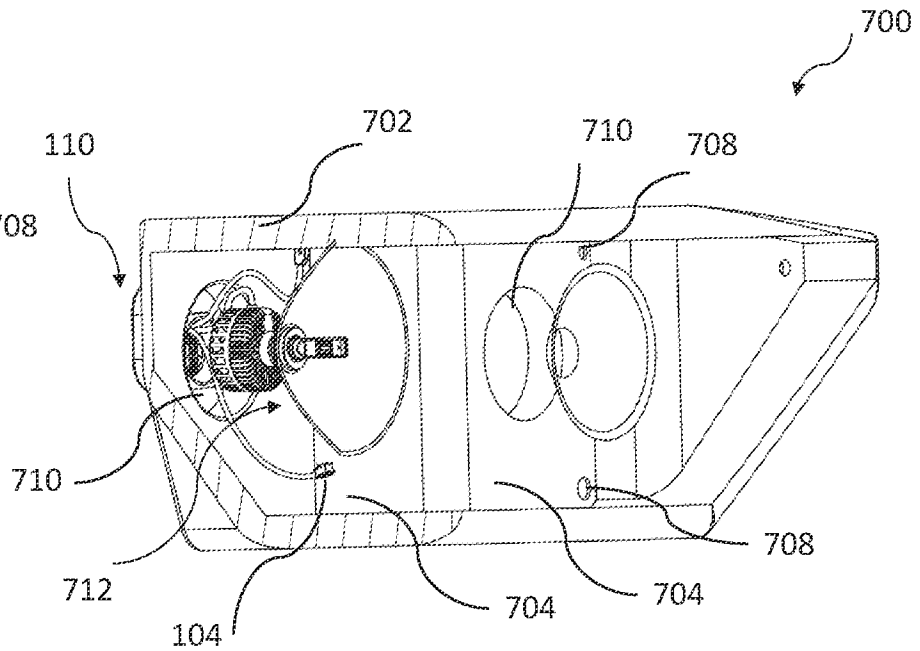
FIG. 7B is a schematic partial sectional view of the vehicle head lamp assembly of FIG. 7A.
Figure 7A:
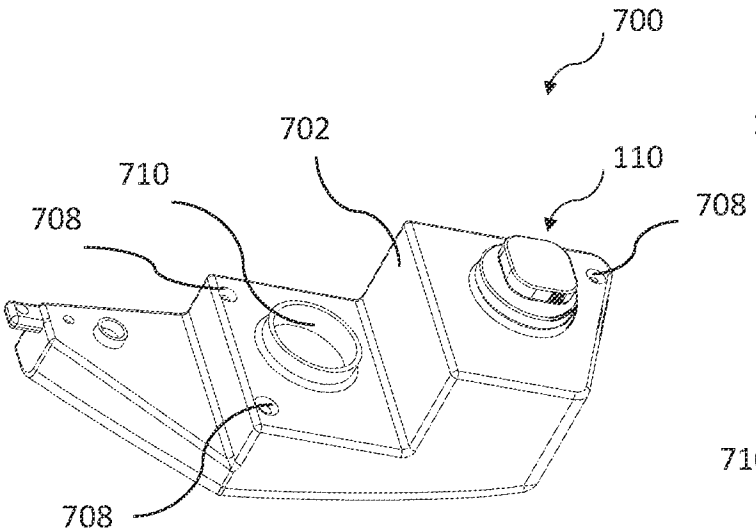
FIG. 7A is a schematic perspective view of vehicle head lamp assembly including a ventilation and temperature control assembly according to embodiments of the present disclosure.

FIG. 7A is a schematic perspective view of vehicle head lamp assembly 700 including a ventilation and temperature control assembly 100 according to embodiments of the present disclosure. FIG. 7B is a schematic partial sectional view of the vehicle head lamp assembly 700 of FIG. 7A.

The vehicle head lamp assembly 700 includes a lamp housing 702 having lamp chambers 704 for housing head lamps therein. A lamp mounting port 710 is formed through the lamp housing 702 for each lamp chamber 704. Venting holes 708 are also formed through the lamp housing 702 for each lamp chamber 704. A lamp 712 is mounted in the lamp chamber 704 through the lamp mounting port 710. The ventilation and temperature control assembly 100 is attached to the lamp housing 702 at the lamp mounting port 710. The sensor 104 is disposed in the lamp chamber 704.

The arrangement in the vehicle head lamp assembly 700 may be used for installing new head lamps that can be attached to the ventilation and temperature control assembly 100. In some embodiments, the ventilation and temperature control assembly 100 is attached to or integrated with the lamp 712.

Figure 8B:
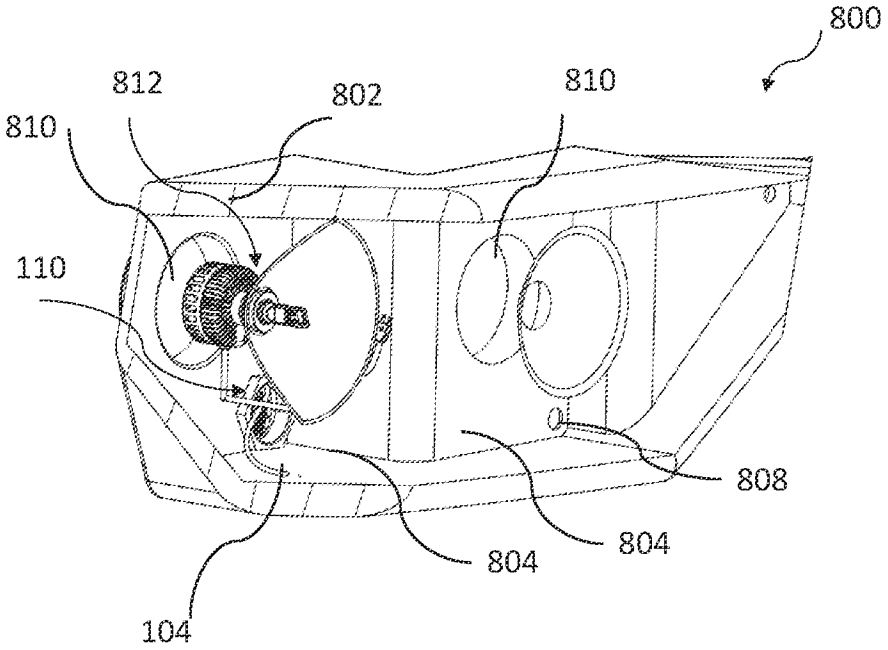
FIG. 8B is a schematic partial sectional view of the vehicle head lamp assembly of FIG. 8A.
Figure 8A:
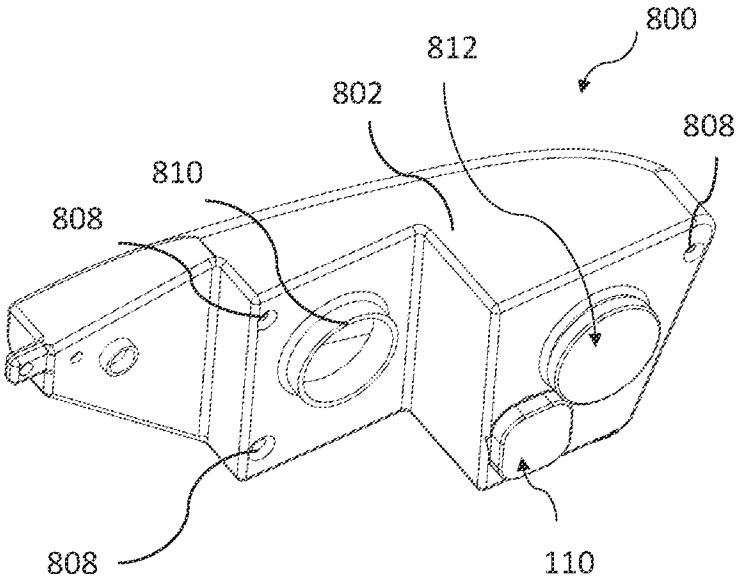
FIG. 8A is a schematic perspective view of vehicle head lamp assembly including a ventilation and temperature control assembly according to embodiments of the present disclosure.

FIG. 8A is a schematic perspective view of vehicle head lamp assembly 800 including a ventilation and temperature control assembly according to embodiments of the present disclosure. FIG. 8B is a schematic partial sectional view of the vehicle head lamp assembly 800 of FIG. 8A.

The vehicle head lamp assembly 800 includes a lamp housing 802 having lamp chambers 804 for housing head lamps therein. A lamp mounting port 810 is formed through the lamp housing 802 for each lamp chamber 804. Venting holes 808 are also formed through the lamp housing 802 for each lamp chamber 804. A lamp 812 is mounted in the lamp chamber 804 through the lamp mounting port 810. The ventilation and temperature control assembly 100 is attached to the lamp housing 802 at an auxiliary port formed through the lamp housing 802. The sensor 104 is disposed in the lamp chamber 804.

The arrangement in the vehicle head lamp assembly 800 may be used for retrospectively fitting a ventilation and temperature control assembly 100 to existing vehicle head lamp assemblies.

Embodiments of the present disclosure provide apparatus and methods for improving operating condition around light sources, such as vehicle lamps. The ventilation and temperature control assembly according to the present disclosure provides external ventilation to a light source. The ventilation around the light source is automatically turned on or off according to conditions, such as temperature around the light source. The ventilation and temperature control assembly improves cooling and temperature distribution around the light source and its circuits, thereby increasing life span of the light source. The ventilation and temperature control assembly also prevents and reduces condensation around the light source, thus improving its optical performance. The vent valve closes the internal volume of a light source, thus preventing damage to the light source by external dusts.

Some embodiments of the present disclosure provide a ventilation and temperature control assembly for a light source. The ventilation and temperature control assembly includes a ventilation unit and a sensor. The ventilation unit comprises a housing having a first port and a second port, and a ventilation fan disposed in the housing near the first port, wherein the ventilation fan is configured to facilitate an air flow through the housing between the first port and the second port. The sensor is connected to the ventilation unit, wherein the ventilation fan is switched on and off according to measurements of the sensor.

In one or more embodiments, the sensor includes a temperature sensor.

In one or more embodiments, wherein the ventilation unit further comprises a valve disposed in the housing between the first port and the second port.

In one or more embodiments, the ventilation and temperature control assembly further includes a controller, wherein the controller is connected to the ventilation fan, the sensor, and the valve.

In one or more embodiments, wherein the housing includes an inner wall, the inner wall divides an inner volume of the housing into a first chamber and a second chamber, and the valve is positioned to open and close an inner port formed through the inner wall.

In one or more embodiments, the ventilation fan, the controller, and the valve are disposed in the first chamber.

In one or more embodiments, the ventilation and temperature control assembly further includes a power adaptor connected to the controller, and a light source adaptor connected to the controller, wherein the light source adaptor is configured to provide power to a light source.

Some embodiments of the present disclosure provide a climate control device for vehicle lamps, comprising a housing, wherein the housing has an inlet port and an outlet port, and a flow path is formed in the housing between the inlet port and the outlet port, a ventilation fan disposed in the flow path and configured to direct fluid flow from the inlet port to the outlet port, and a valve disposed in the flow path, wherein the valve is operable to open and close the flow path.

In one or more embodiments, the climate control device for vehicle lamps further comprises a controller configured to operate the ventilation fan and the valve.

In one or more embodiments, the controller is disposed in the housing in the flow path.

In one or more embodiments, the climate control device for vehicle lamps further comprises a sensor disposed outside the housing, wherein the sensor is connected to the controller.

In one or more embodiments, the climate control device for vehicle lamps further comprises a light source adaptor configured to provide electrical power to a light source, and a power adaptor configured to connect with an onboard power supply on a vehicle.

In one or more embodiments, the housing includes an inner wall, an inner port is formed through the inner wall, and the valve is disposed in the inner port formed through the inner wall.

In one or more embodiments, the controller is disposed between the ventilation fan and the inner port formed through the inner wall.

In one or more embodiments, a fastener configured to mount the housing on a vehicle lamp housing.

In one or more embodiments, the housing is shaped to mount through an existing lamp mounting port in a vehicle.

Some embodiments of the present disclosure provide a method for controlling a light source. The method includes turning on a light source disposed in a light source housing, monitoring temperature in the light source housing, and extracting an air flow from the light source housing using an external ventilation fan when the temperature in the light source housing reaches a pre-set temperature value.

In one or more embodiments, the method further comprises, prior to extracting the air flow from the light source housing, opening a valve connected between an inner volume and an exterior volume of the light source housing.

In one or more embodiments, the method further comprises keeping the light source housing enclosed after turning on the light source to allow temperature in the light source housing to rise up.

In one or more embodiments, the method further comprises turning off the external ventilation fan when the temperature in the light source housing drops below the pre-set temperature value.

In one or more embodiments, the method further comprises closing a valve connected between an inner volume and an exterior volume of the light source housing.

While the foregoing is directed to embodiments of the present disclosure, other and further embodiments of the disclosure may be devised without departing from the basic scope thereof.

The invention claimed is:

1. A vehicle light, comprising:

a light housing;

a light source disposed in the light housing;

a ventilation unit attached to the light housing, comprising:

a ventilation housing, wherein the ventilation housing has a first port and a second port, a flow path is formed through the ventilation housing between the first port and the second port, the first port is open to the light housing, and the second port is open to an exterior environment;

a ventilation fan disposed in the flow path and operable to direct fluid flow between the first port and the second port; and a valve disposed in the flow path, wherein the valve is operable to open and close the flow path.

2. The vehicle light of claim 1, wherein the ventilation fan is operable to direct a fluid flow from the first port to the second port.

3. The vehicle light of claim 1, wherein the light housing defines an enclosure, the first port of the ventilation unit is open to the enclosure of the light housing, and the ventilation unit is operable to generate an air flow in the enclosure of the light housing.

4. The vehicle light of claim 3, wherein the light housing comprises a lens, and the air flow in the enclosure is operable to vaporize condensation on the lens or defrost ice formed on the housing.

5. The vehicle light of claim 4, wherein an air hole formed through the light housing, the air hole allows an air circulation in the enclosure when the ventilation fan is turned on.

6. The vehicle light of claim 3, further comprising a controller configured to operate the ventilation fan and the valve.

7. The vehicle light of claim 6, further comprising a sensor disposed in the enclosure of the light housing, wherein the sensor is connected to the controller, and controller switches on and off the ventilation fan and the valve according to measurements of the sensor.

8. The vehicle light of claim 7, wherein the sensor is disposed in the enclosure near the light source.

9. The vehicle light of claim 7, wherein the sensor is a temperature sensor.

10. The vehicle light of claim 7, wherein the sensor is a humidity sensor.

11. The vehicle light of claim 1, wherein the light housing includes a lamp mounting port, and the light source is mounted through the lamp mounting port.

12. The vehicle light of claim 11, wherein the ventilation housing is shaped to mount at the lamp mounting port and the ventilation unit is attached to the light housing at the lamp mounting port.

13. The vehicle light of claim 11, wherein the light housing includes an auxiliary port, and the ventilation unit is attached to the light housing at the auxiliary port.

14. The vehicle light of claim 1, wherein the light source is a LED light.

15. The vehicle light of claim 1, wherein the ventilation housing includes an inner wall, an inner port is formed through the inner wall, and the valve is disposed in the inner port formed through the inner wall.

16. The vehicle light of claim 15, wherein the controller is disposed between the ventilation fan and the inner port formed through the inner wall.

17. A method for operating a vehicle light, comprising:

providing a vehicle light comprising:

a light housing defining an enclosure;

a light source disposed in the light housing;

a ventilation unit attached to the light housing, comprising:

a ventilation housing, wherein the ventilation housing has a first port and a second port, a flow path is formed through the ventilation housing between the first port and the second port, the first port is open to the enclosure of the light housing, and the second port is open to an exterior environment;

a ventilation fan disposed in the flow path and operable to direct fluid flow between the first port and the second port; and a valve disposed in the flow path, wherein the valve is operable to open and close the flow path;

turning on the light source; and extracting an air flow from the enclosure of the light housing using the ventilation fan of the ventilation unit.

18. The method of claim 17, further comprising:

monitoring temperature in the enclosure of the light housing; and switching on and off the valve according to the temperature of the enclosure.

19. The method of claim 18, prior to extracting the air flow from the light housing, opening the valve.

20. The method of claim 17, further comprising generating an air circulation in the enclosure using the ventilation fan to vaporize condensation on the lens or defrost ice formed on the housing.

* * * * *